US009597726B2

(12) United States Patent
Takahashi

(10) Patent No.: US 9,597,726 B2
(45) **Date of Patent: *Mar. 21, 2017**

(54) METAL MELT CIRCULATING DRIVE DEVICE AND MAIN BATH INCLUDING THE SAME

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 206 days.

This patent is subject to a terminal disclaimer.

(21) Appl. No.: 14/391,522

(22) PCT Filed: Mar. 31, 2014

(86) PCT No.: PCT/JP2014/059414

§ 371 (c)(1),
(2) Date: Oct. 9, 2014

(87) PCT Pub. No.: WO2014/175002

PCT Pub. Date: Oct. 30, 2014

(65) Prior Publication Data

US 2015/0283605 A1 Oct. 8, 2015

(30) Foreign Application Priority Data

Apr. 23, 2013 (JP) ..... 2013-090729

(51) Int. Cl.
*B22D 41/08* (2006.01)
*B22D 1/00* (2006.01)
(Continued)

(52) U.S. Cl.
CPC ..... *B22D 1/00* (2013.01); *B22D 41/00* (2013.01); *F27D 27/00* (2013.01); *F27D 27/005* (2013.01); *F27D 2003/0054* (2013.01)

(58) Field of Classification Search
CPC ..... B22D 1/00; B22D 41/00
(Continued)

(56) References Cited

U.S. PATENT DOCUMENTS

2011/0197709 A1 8/2011 Koriyama et al.
2014/0284854 A1 9/2014 Takahashi
2015/0283605 A1* 10/2015 Takahashi ..... B22D 1/00 266/234

FOREIGN PATENT DOCUMENTS

EP 1 674 814 A2 6/2006
EP 1 674 814 A3 6/2006
(Continued)

OTHER PUBLICATIONS

Machine generated English language translation of JP 2011-012950 A, Jan. 2011.*

(Continued)

*Primary Examiner* — Scott Kastler
(74) *Attorney, Agent, or Firm* — Oblon, McClelland, Maier & Neustadt, L.L.P.

(57) ABSTRACT

A melt circulating drive device mounted on a side wall of a main bath and driven to agitate nonferrous metal melt present in a melt storage room storing nonferrous metal melt of the main bath. The melt circulating drive device includes a melt drive tank, a melt drive unit, and a partition plate. The melt drive tank includes a hermetically-sealed drive chamber including an opening allowing the drive chamber to communicate with the melt storage room, and the melt drive tank stores melt, which flows from the opening, in the drive chamber. The melt drive unit includes a permanent magnet unit rotated about a first up and down axis while making magnetic lines of force up and down pass through the melt, and a drive unit for the permanent magnet unit that rotates the melt, about the first up and down axis by rotationally driving the permanent magnet unit.

6 Claims, 7 Drawing Sheets

(51) Int. Cl.

| | |
|---|---|
| ***F27D 27/00*** | (2010.01) |
| ***B22D 41/00*** | (2006.01) |
| *F27D 3/00* | (2006.01) |

(58) Field of Classification Search
USPC ..... 266/234
See application file for complete search history.

(56) References Cited

FOREIGN PATENT DOCUMENTS

| | | | |
|---|---|---|---|
| JP | 2003-329367 | A | 11/2003 |
| JP | 2006-010214 | A | 1/2006 |
| JP | 4376771 | | 12/2009 |
| JP | 2010-281474 | A | 12/2010 |
| JP | 2011-12950 | A | 1/2011 |
| JP | 2011-12951 | A | 1/2011 |
| JP | 2011-106689 | | 6/2011 |
| WO | WO 2013/047668 | A1 | 4/2013 |

OTHER PUBLICATIONS

Office Action issued Dec. 10, 2015 in Korean Patent Application No. 10-2014-7021315 (with English language translation).
International Search Report issued Jun. 24, 2014 in PCT/JP2014/059414 (with English translation and Written Opinion).
Extended European Search Report issued on Aug. 5, 2016 in Patent Application No. 14730728.4.

* cited by examiner

METAL MELT CIRCULATING DRIVE DEVICE AND MAIN BATH INCLUDING THE SAME

CROSS-REFERENCE TO RELATED APPLICATIONS

This application is based upon and claims the benefit of priority from Japanese Patent Application No. 2013-90729, filed Apr. 23, 2013; the entire contents of which are incorporated herein by reference.

BACKGROUND OF THE INVENTION

Field of the Invention

The present invention relates to a metal melt circulating drive device and a main bath including the metal melt circulating drive device.

Background Art

Circulation and agitation of melt are essential processes to efficiently and quickly melt iron, nonferrous metal, or the like. In the past, for the circulation and agitation of melt, inert gas has been blown into the melt or the melt has been forcibly agitated by a mechanical pump. Further, there is a magnet type agitator that includes permanent magnets where magnetic lines of force are horizontally emitted and enter and which are placed next to the melt present in a container and drives the melt by rotating the permanent magnets while the magnetic lines of force emitted from the permanent magnets pass through the melt (Patent Literatures 1 and 2).

Patent Literature 1: Japanese Patent Application Laid-Open No. 2011-106689

Patent Literature 2: Japanese Patent No. 4376771

However, a method of blowing inert gas has problems in that it is difficult to avoid the clogging of a blowing pipe for gas and troublesome maintenance such as replacement of the blowing pipe is required. A method using the mechanical pump has a problem in that large running cost is required. Further, the agitator disclosed in Patent Literature 1 has a problem in that the size of the device is increased and the cost of equipment is large. Furthermore, the agitator disclosed in Patent Literature 2 has problems in that melt may leak and a high level of maintenance is required. Further, in the magnet type agitator of Patent Literatures 1 and 2, a furnace body is reinforced with a stainless steel. However, there also is a problem in that the stainless steel plate generates heat.

SUMMARY OF THE INVENTION

An object of the invention is to solve these problems and to provide a metal melt circulating drive device that is more inexpensive and is easy to use.

There is provided a melt circulating drive device that is mounted on a side wall of a main bath and is driven to agitate nonferrous metal melt present in a melt storage room storing nonferrous metal melt of the main bath, the melt circulating drive device comprising:

a melt drive tank that includes a hermetically-sealed drive chamber, the drive chamber including an opening allowing the drive chamber to communicate with the melt storage room, and the melt drive tank storing melt, which flows from the opening, in the drive chamber;

a melt drive unit that is installed above the melt drive tank, and includes a permanent magnet unit that is rotated about a first up and down axis while making magnetic lines of force pass through along the up and down direction the melt present in the drive chamber of the melt drive tank, and a drive unit for the permanent magnet unit that rotates the melt, which is present in the drive chamber, about the first up and down axis by rotationally driving the permanent magnet unit; and a partition plate that is disposed upright in the drive chamber of the melt drive tank along a direction where the drive chamber and the melt storage room communicate with each other, an outer end of the partition plate being positioned in a region of the opening, an inner end thereof being positioned in the drive chamber, a melt rotating gap being formed between the inner end and an inner surface of the drive chamber facing the inner end, the partition plate dividing the opening of the drive chamber into a first opening and a second opening positioned on both right and left sides of the partition plate, and the melt drive unite rotates the melt in order to collide with one surface of the partition plate to discharge the melt from the first opening, so as to allow external melt to be sucked into the drive chamber, in which the pressure of the melt has been reduced, from the second opening.

A melting furnace of the invention includes the melt circulating drive device and the main bath.

DETAILED DESCRIPTION OF THE INVENTION

When nonferrous metal, such as a conductor (conductive body), such as Al, Cu, Zn, an alloy of at least two of them, or an Mg alloy, is to be melted, the prevention of leakage of melt is most important in a job side of melting although having been briefly described above. That is, the scattering of nonferrous metal, which has been melted in a furnace (a melting furnace or a holding furnace), from an upper opening of the furnace or the leakage of the nonferrous metal from the furnace caused by the damage or breakage of the furnace should be reliably prevented. The reason for this is that the scattering or leakage of melted nonferrous metal directly affects the safety of a worker. For this reason, a method of agitating melt by directly inserting a mechanical pump into melt in a melting furnace or a holding furnace has been avoided in recent years, and a method of indirectly agitating melt without contact with the melt has been mainly used. However, since melt, which is present in the furnace, needs to be agitated through a furnace wall in that case, there has been a problem in that it is not possible to avoid the increase in the size of an agitator. For example, the device disclosed in Patent Literature 1 is also not an exception of the increase in size, and the size of the device is large since the weight of the device is also close to 10 tons.

Accordingly, according to an aspect of the invention, a structure in which a unit for driving melt is installed above a melt tank is employed to provide a device that is compact and obtains a large drive force without leakage of melt.

An embodiment of the invention will be described in detail below.

Figure 1:
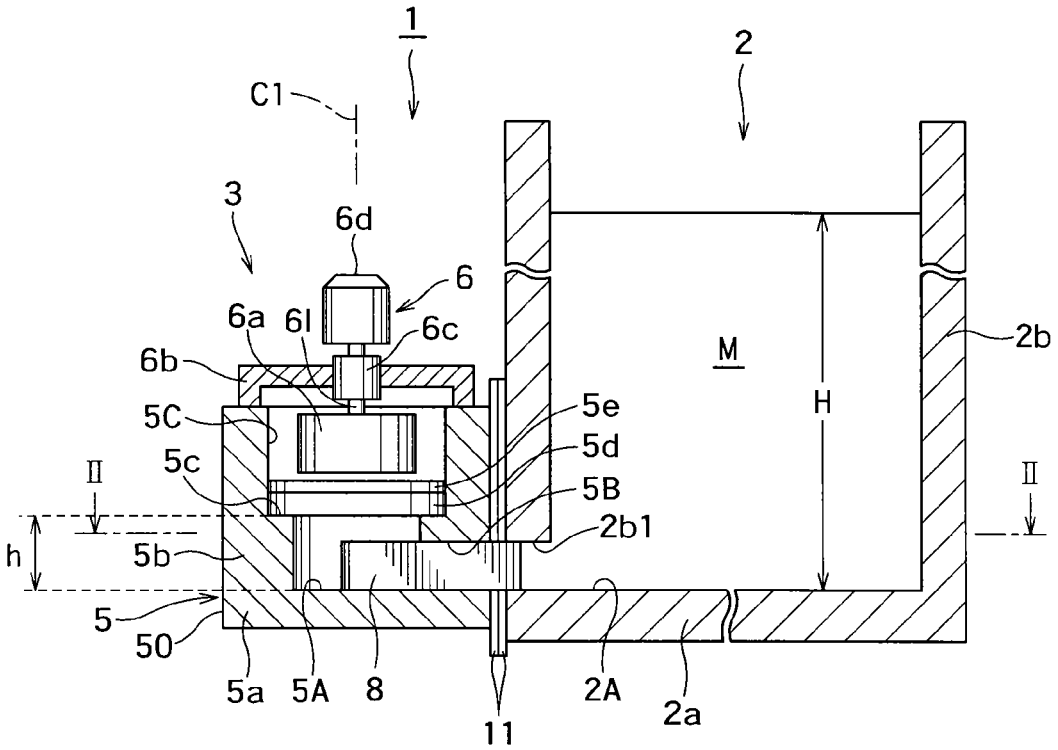
FIG. 1 is a longitudinal sectional view of a nonferrous metal melting furnace as an embodiment of the invention.
Figure 2:
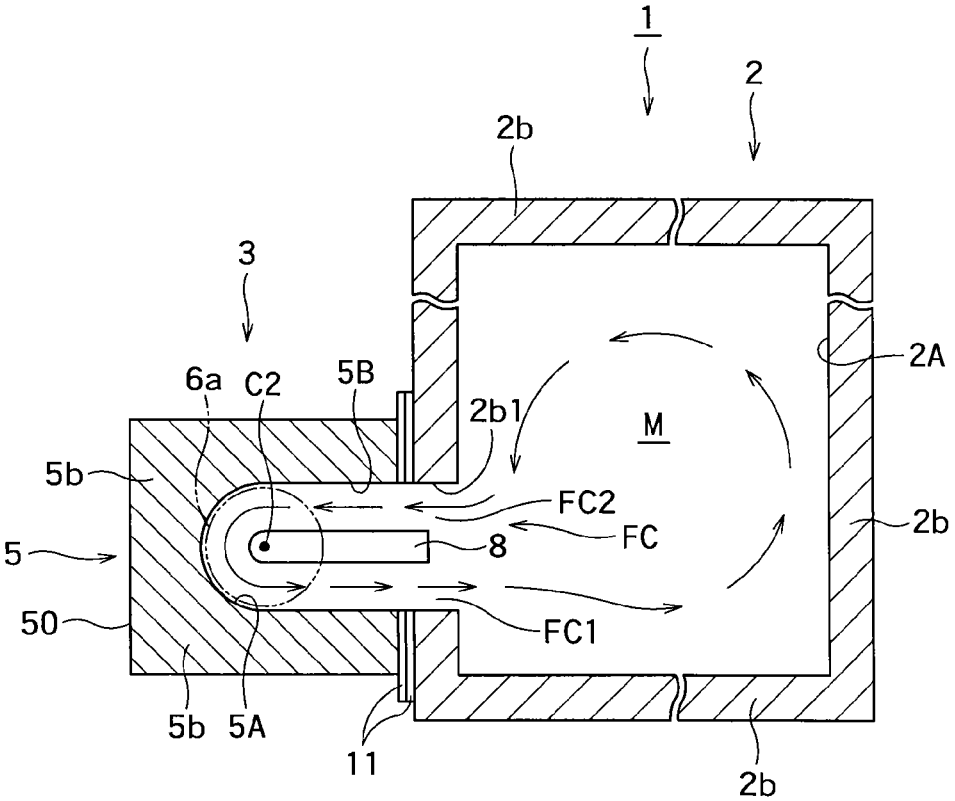
FIG. 2 is a cross-sectional view taken along line II-II of FIG. 1.

FIG. 1 is a longitudinal sectional view of a nonferrous metal melting furnace 1 as an embodiment of the invention, and FIG. 2 is a cross-sectional view taken along line II-II of FIG. 1. As understood from FIGS. 1 and 2, the melting furnace 1 includes a furnace body 2 serving as a main bath (a melting furnace or a holding furnace) and a melt circulating drive device 3 serving as a pump that is connected to the furnace body 2 with flanges 11 interposed therebetween so as to communicate with the furnace body 2.

The furnace body 2 is similar to a general-purpose melting furnace. Particularly, as understood from FIG. 1, the furnace body 2 includes a melt storage room 2A of which the upper side is opened and which stores nonferrous metal melt M therein, and includes a burner (not illustrated) that heats and melts chips of aluminum or the like as nonferrous metal having been put in the melt storage room.

In more detail, in FIG. 1, the melt storage room 2A of the furnace body 2 is formed by a bottom wall 2*a* and four side walls 2*b*. A communication port 2*b*1, which allows the storage room to communicate with the melt circulating drive device 3, is formed at one of the side walls 2*b*. As understood from the following description, the communication port 2*b*1 functions as a communication port, which allows the melt M to flow in and out between the furnace body 2 and the melt circulating drive device 3, by a drive force of the melt circulating drive device 3 serving as the pump. That is, the nonferrous metal melt M is made to flow into the furnace body 2 from the melt circulating drive device 3 through the communication port 2*b*1 by the discharge force of the melt circulating drive device 3. Reversely, the melt M, which is present in the furnace body 2, is made to flow out to the melt circulating drive device 3 by a suction force of the melt circulating drive device 3.

As particularly understood from FIG. 1, the melt circulating drive device 3, which is connected to the furnace body 2 so as to communicate with the furnace body 2, includes a melt drive tank 5 that includes a hermetically-sealed drive chamber 5A of which only one surface (side surface) of six surfaces is opened laterally in FIG. 1, and a drive unit 6 that includes a permanent magnet installed above the melt drive tank 5 outside the melt drive tank 5.

Figure 3:
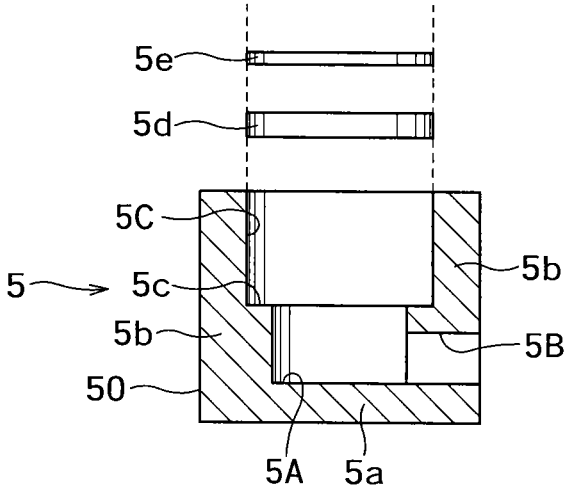
FIG. 3 is an exploded longitudinal sectional view of a melt drive tank.

As particularly understood from FIG. 3, the melt drive tank 5 is formed as a hermetically-sealed tank of which only so-called one surface is opened laterally in FIG. 3. That is, the melt drive tank 5 includes an opening 5B at one side surface thereof, and the drive chamber 5A communicates with the communication port 2*b*1 of the furnace body 2 and the melt storage room 2A of the furnace body 2 through the opening 5B. Since the melt drive tank 5 is hermetically sealed, it is possible to prevent the melt M from being scattered even though a permanent magnet unit 6*a* to be described below is rotated at a high speed to obtain a larger drive force.

As particularly understood from FIG. 2, the melt drive tank 5 includes a partition plate 8 dividing a flow channel FC, which connects the drive chamber 5A of the melt drive tank 5 with the melt storage room 2A of the furnace body 2, into a left discharge flow channel (or a suction flow channel) FC1 and a right suction flow channel (a discharge flow channel) FC2 that are parallel to a flow direction. As understood from FIG. 1, the partition plate 8 is disposed so that the longitudinal direction of the partition plate 8 is parallel to the flow direction, and divides the flow channel FC into the left discharge flow channel FC1 and the right suction flow channel FC2. Accordingly, the melt M, which is present in the drive chamber 5A, flows in and out between the drive chamber 5A and the melt storage room 2A while being divided into flows corresponding to the right and left flow channels FC1 and FC2.

Figure 4:
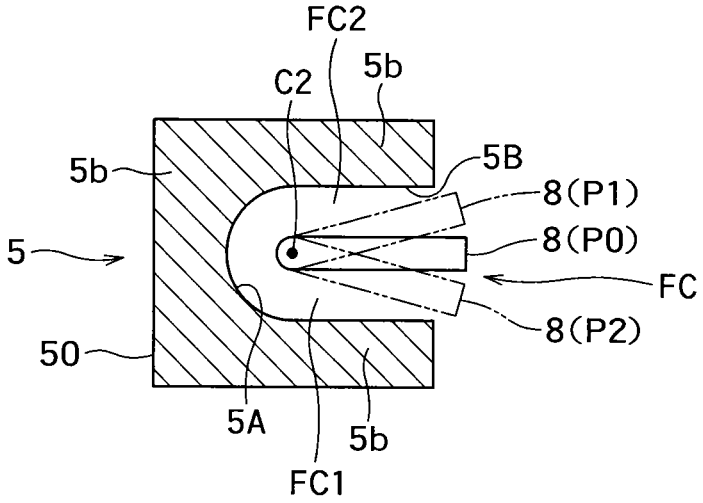
FIG. 4 is a diagram illustrating a rotation state of a partition plate.

The partition plate 8 is provided upright and is detachably mounted in the drive chamber 5A of the melt drive tank 5. Accordingly, even when the partition plate 8 is damaged with age by the high-temperature melt M, maintenance is easily performed. An outer end of the partition plate 8 is positioned in a region of the opening 5B, an inner end thereof is positioned in the drive chamber 5A, and a melt rotating gap S is formed between an inner surface of the drive chamber 5A, which faces the inner end, and the inner end. The partition plate 8 divides the opening (flow channel FC) of the drive chamber 5A into a first opening (flow channel FC1) and a second opening (flow channel FC2) that are positioned on the right and left sides of the partition plate 8. The melt which is rotated in order to collide with one surface of the plate 8 is discharged from the second opening, so as to allow external melt to be sucked into the drive chamber, in which the pressure of the melt has been reduced. Further, as particularly understood from FIG. 4, the partition plate 8 can be rotated relative to the melt drive tank 5 about a up and down axis (a second up and down axis) C2 like a so-called rudder of a ship, and the position of the partition plate 8 can be held. That is, the partition plate 8 is mounted so that an angle of the partition plate 8 can be adjusted. In other words, the partition plate 8 is rotated about the substantially up and down axis C2 at one end of the partition plate 8 in the longitudinal direction thereof, and the position of the partition plate 8 can be held. For example, in FIG. 4, the partition plate 8 can take, for example, positions P1 and P2 where a rudder has been turned to the right and left in addition to a position PO that is present in the midst of the flow channel FC. Accordingly, as understood from FIG. 4, states in which the melt M is efficiently discharged from the drive chamber 5A and flows into the drive chamber 5A between the drive chamber 5A and the melt storage room 2A are taken by the change of the widths of the discharge flow channel FC1 and the suction flow channel FC2, the tapers thereof, or the like when viewed from above. Accordingly, it is possible to rotate the melt, which is present in the melt storage room 2A, at a speed, which is as high as possible, as described below.

In more detail, the melt drive tank 5 has the following structure. That is, as particularly understood from FIG. 3, the melt drive tank 5 includes a substantially container-shaped tank body 50 which is formed by a bottom wall 5*a* and four side walls 5*b* surrounding four sides and of which the upper side is opened. The opening 5B is formed at one of the four side walls 5*b*. As understood from the FIG. 1, the opening 5B communicates with the communication port 2*b*1 of the furnace body 2 so that the drive chamber 5A and the melt storage room 2A communicate with each other. Thick portions of the four side walls 5*b* are counterbored, that is, the inner surfaces of the four side walls 5*b* are counterbored in a circular shape from upper end faces thereof to the middle portions thereof, so that an annular stepped portion (seat) 5*c* is formed. A disc-shaped upper lid 5*d* made of a refractory material falls and hermetically fitted in the counterbored stepped portion 5*c* as a lid, and a heat insulating plate 5*e* made of a refractory material is placed on the upper lid 5*d*. Accordingly, a permanent magnet receiving space 5C of which the upper side is opened is formed by the upper lid 5*d* and the four side walls 5*b*. A permanent magnet unit 6*a* of the drive unit 6 is received in the permanent magnet receiving space 5C so as to be rotatable about an axis (first up and down axis) C1.

In more detail, the drive unit 6 includes a substantially pot lid-like support frame 6*b*. The support frame 6*b* is placed on and fixed to the upper surfaces of the four side wall 5*b* of the melt drive tank 5. The permanent magnet unit 6*a* is rotatably supported by a bearing 6*c* that is mounted on the central portion of the support frame 6*b*. An upper portion of a shaft 61 of the permanent magnet unit 6*a* can be driven by a drive motor 6*d*. The drive motor 6*d* is connected to an external control panel (not illustrated), and the drive of the drive motor 6*d* can be controlled by the external control panel. In FIG. 1, the permanent magnet unit 6*a* is provided as close as possible to the heat insulating plate 5*e*. Accordingly, as understood from the following description, magnetic lines ML of force generated from the permanent magnet unit 6*a* further pass through the melt M, which is present in the drive chamber 5A, with high density after passing through the heat insulating plate 5*e* and the upper lid 5*d*.

Figure 5:
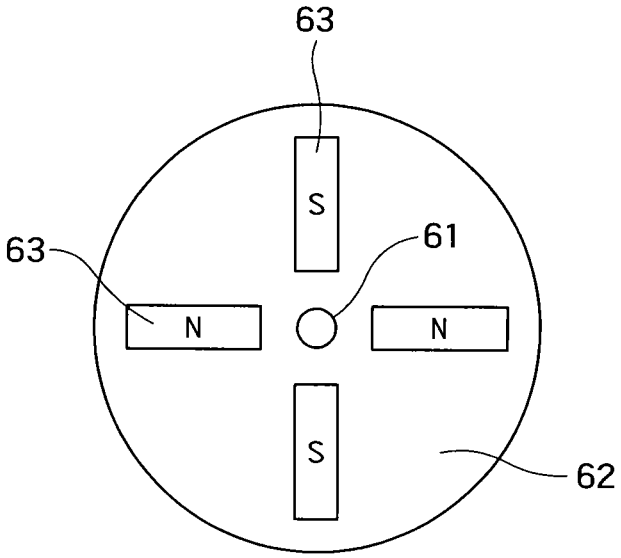
FIGS. 5(*a*) and 5(*b*) are a bottom view of a permanent magnet unit and a diagram illustrating magnetic lines of force generated from the permanent magnet unit.
Figure 5:
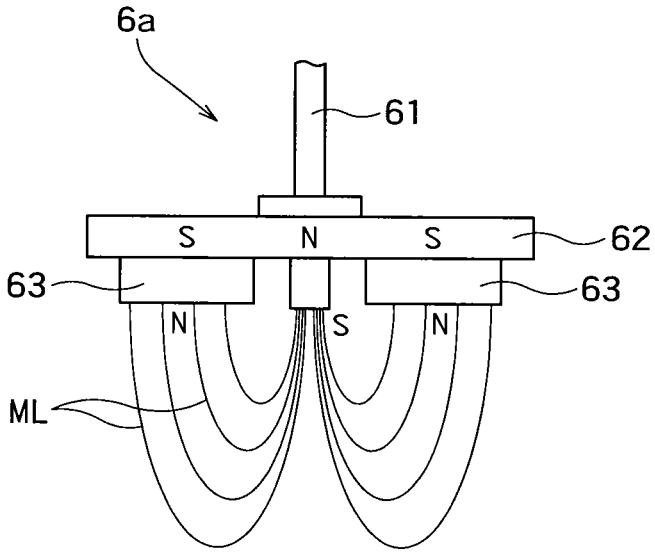

The detail of the permanent magnet unit 6*a* is illustrated in FIGS. 5(*a*) and 5(*b*). FIG. 5(*a*) is a bottom view of the permanent magnet unit 6*a* when viewed from the bottom, and FIG. 5(*b*) is a front view of the permanent magnet unit when viewed in a lateral direction as in FIG. 1. As understood from FIG. 5(*b*), a rotating plate 62 is fixed to the shaft 61. As understood from FIG. 5(*a*), four permanent magnets 63 are radially fixed to the bottom of the rotating plate 62 at an interval of 90°. The four permanent magnets 63 are magnetized in the up and down direction as understood from FIG. 5(*b*), and are magnetized so that N poles and S poles are alternately arranged as the magnetic poles of the lower end faces of the permanent magnets. Accordingly, the magnetic lines ML of force emitted from the N poles enter adjacent S poles as illustrated in FIG. 5(*b*). That is, the magnetic lines ML of force enter the S poles from the N poles while having high density. As understood from FIG. 1, the magnetic lines ML of force emitted from the N poles pass through the heat insulating plate 5*e* and the upper lid 5*d* and pass through the melt M present in the drive chamber 5A. Then, the magnetic lines ML of force are reversed and pass through the upper lid 5*d* and the heat insulating plate 5*e* in a reverse order and enter the adjacent S poles. Since the magnetic lines ML of force pass through the melt M as described above, the magnetic lines ML of force are moved in the melt M when the rotating plate 62, that is, the permanent magnets 63 are rotated, for example, counterclockwise. Accordingly, eddy current is generated and the melt M is rotated in the same direction as the rotation direction of the permanent magnets 63. When the rotating speed of the permanent magnets 63 is increased, the rotating speed of the melt M is also increased. However, melt M, which has high temperature and is dangerous when a worker is exposed to the melt, might be scattered to the outside over the side walls 5*b* of the drive chamber 5A in the related art. However, since the drive chamber 5A is covered with the upper lid 5*d* so as to be hermetically sealed in this embodiment, it is possible to reliably prevent the melt M from being scattered to the outside from the drive chamber 5A over the side walls 5*b* even though the rotating speed of the melt M is increased. Accordingly, it is possible to suck the melt from the furnace body 2 by further increasing the rotating speed of the permanent magnet unit 6*a* and more strongly driving the melt M, which is present in the drive chamber 5A, to discharge the melt to the furnace body 2. Eventually, it is possible to more strongly drive the melt M, which is present in the melt storage room 2A of the furnace body 2, with higher speed.

Since the amount of the melt M circulated in the melt storage room 2A is proportional to the rotating speed of the permanent magnet unit 6*a* as understood from the above description, it is possible to arbitrarily adjust the required amount of circulated melt by an external power control panel. Accordingly, there is no limit when the thickness of the refractory material forming the melt drive tank 5 is set, and it is possible to arbitrarily determine the thickness of the refractory material. Therefore, it is also possible to make the refractory material thick in consideration of safety when there is a concern that the melt may leak.

It is thought that the operation of the melt circulating drive device 3 has almost been understood from the above description, but the operation of the melt circulating drive device will be described in more detail below.

Figure 6:
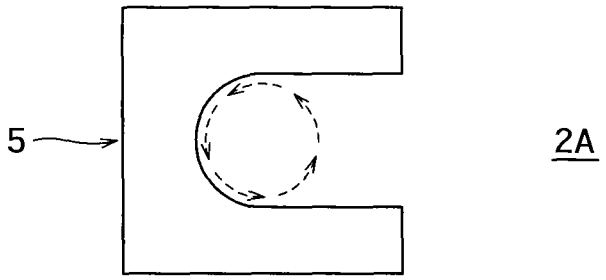
FIGS. 6(*a*) to 6(*d*) are diagrams illustrating the function of the partition plate in the melt drive tank.
Figure 6:
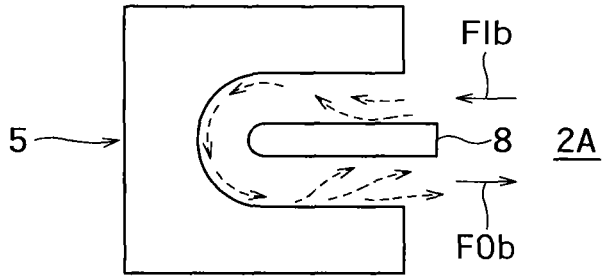
Figure 6:
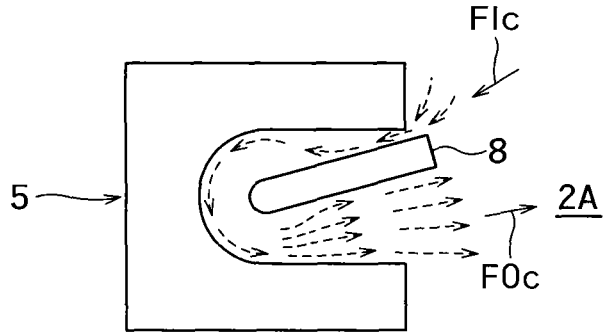
Figure 6:
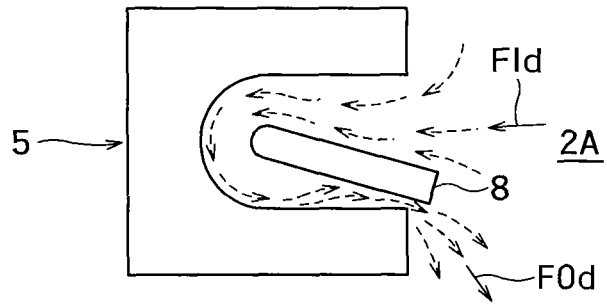

FIGS. 6(*a*) and 6(*d*) are diagrams illustrating the flow of the melt M that is generated by the drive of the permanent magnet unit 6*a* in the drive chamber 5A of the melt circulating drive device 3.

FIG. 6(*a*) illustrates a case in which the partition plate 8 is not provided. In this case, the melt M is merely rotated in the drive chamber 5A as illustrated by a broken line with the rotation of the permanent magnet unit 6*a*.

FIG. 6(*b*) illustrates a case in which the partition plate 8 is set horizontally in the drawing. In this case, the melt M is also rotated counterclockwise with the counterclockwise rotation of the permanent magnet unit 6*a*, but the rotating melt M collides with the lower surface of the partition plate 8 in FIG. 6(*b*) and the flow direction of the melt is changed into a right direction. For this reason, the melt M flows out to the melt storage room 2A, which is positioned on the right side, as a so-called discharge flow FOb. Accordingly, the pressure of the melt present in the drive chamber 5A is reduced, so that the melt M present in the melt storage room 2A is sucked into the drive chamber 5A, which is positioned on the left side in FIG. 6(*b*), as a suction flow FIb.

FIGS. 6(*c*) and 6(*d*) illustrate cases in which the partition plate 8 are rotated slightly upward and rotated slightly downward. A counterclockwise drive force is applied to the melt M present in the drive chamber 5A in the same manner as described above even in these cases, so that discharge flows FOc and FOd and suction flows FIc and FId are generated. The outflow angles of the discharge flows FOc and FOd and the inflow angles of the suction flows FIc and FId are different from the outflow angle and the inflow angle illustrated in FIG. 6(*b*).

It is possible to change the directions of the discharge flow FOi and the suction flow FIi by changing the direction of the partition plate 8 as illustrated in FIGS. 6(*b*), 6(*c*), and 6(*d*) as described above. Accordingly, it is possible to change the flow of the melt M in the melt storage room 2A that communicates with the drive chamber 5A. That is, when the melt circulating drive device 3 is mounted on the furnace body 2 so as to communicate with the furnace body 2, the melt M present in the melt storage room 2A of the furnace body 2 is also rotated counterclockwise with the counterclockwise rotation of the melt M in the drive chamber 5A. However, the flow aspect of the melt M, which is caused by the rotation, varies depending on various parameters, such as devices, the kind or amount of nonferrous metal to be put in, and the temperature of the melt M. In each aspect, it is possible to adjust the angle of the partition plate 8 so that rotation allowing nonferrous metal, which is put in the furnace body, to be most efficiently melt is performed in the furnace body 2.

Figure 7:
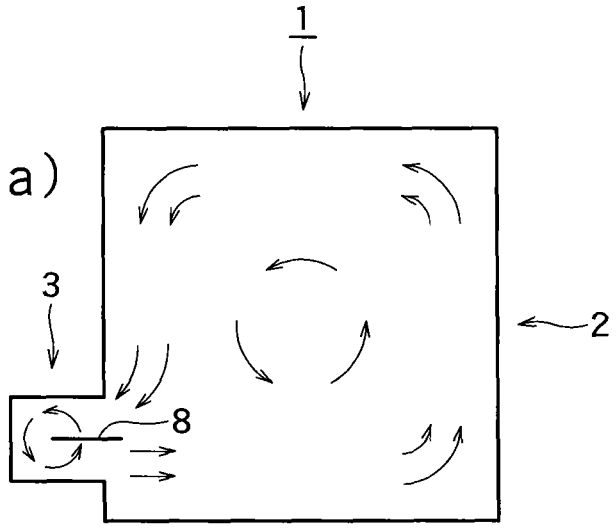
FIGS. 7(*a*) to 7(*c*) are diagrams illustrating the flow of melt, which is generated in a melt circulating drive device and a main bath by the change of the direction of a partition plate, at a certain mounting position where the melt circulating drive device is mounted on the main bath.
Figure 7:
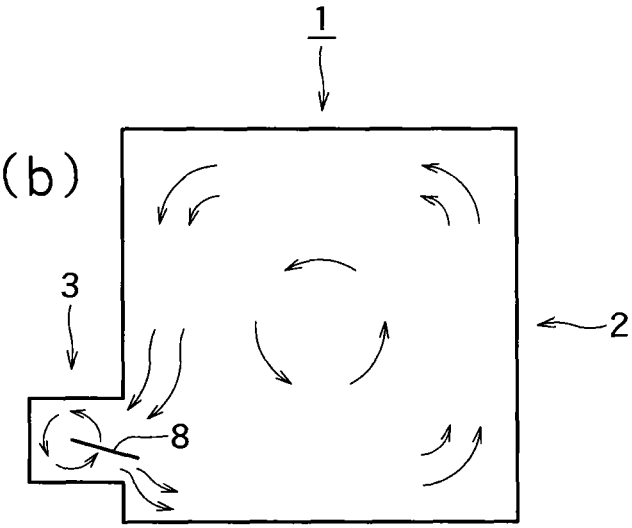
Figure 7:
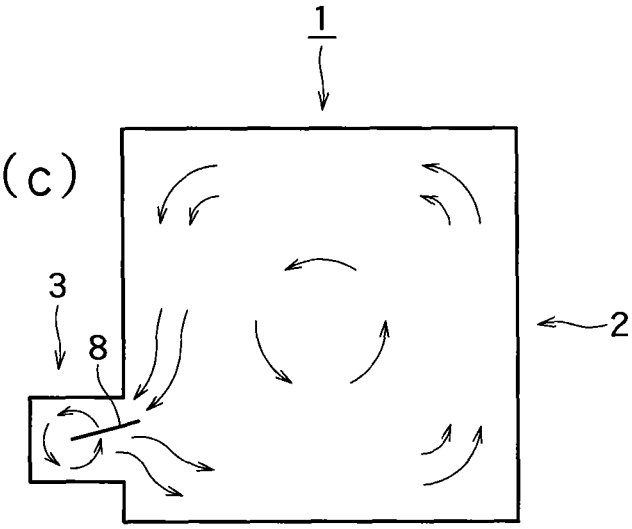

The angle of the partition plate 8 and the rotation aspect of the melt M in the melt storage room 2A are schematically illustrated in FIGS. 7(*a*) to 7(*c*). FIGS. 7(*a*) to 7(*c*) are conceptual diagrams exemplarily made to illustrate that the flow of the melt M in the furnace body 2 is changed when the direction of the partition plate 8 is changed like a rudder, and do not accurately illustrate the flow of the melt M in the furnace body 2. The flow of the melt M is determined depending on not only a flow channel but also a flow velocity (a period of rotation), and is also affected by the kind of nonferrous metal to be put in. Accordingly, the rotation position of the partition plate 8 is determined visually.

Further, the rotating direction of the permanent magnet unit 6*a* can be a clockwise direction opposite to the rotating direction in the above-mentioned case. It is possible to find out the optimum rotation of the melt M in the furnace body 2 in this way.

Figure 8:
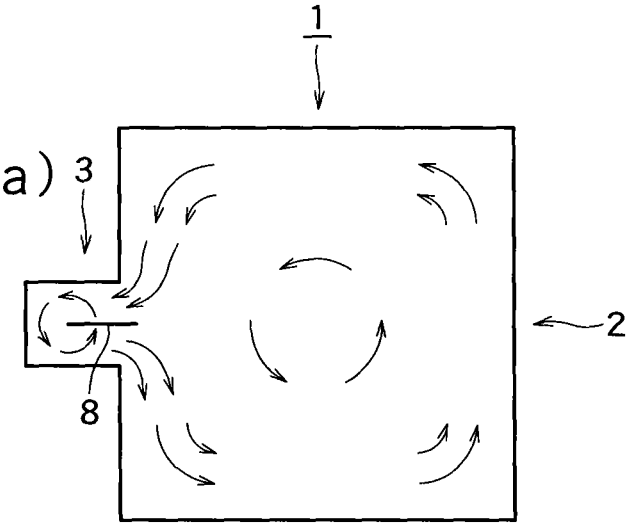
FIGS. 8(*a*) to 8(*c*) are diagrams illustrating the flow of melt, which is generated in a melt circulating drive device and a main bath by the change of the direction of a partition plate, at another mounting position where the melt circulating drive device is mounted on the main bath.
Figure 8:
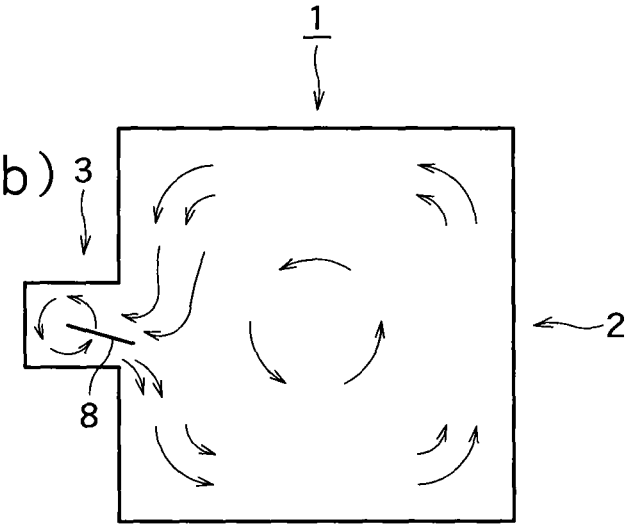
Figure 8:
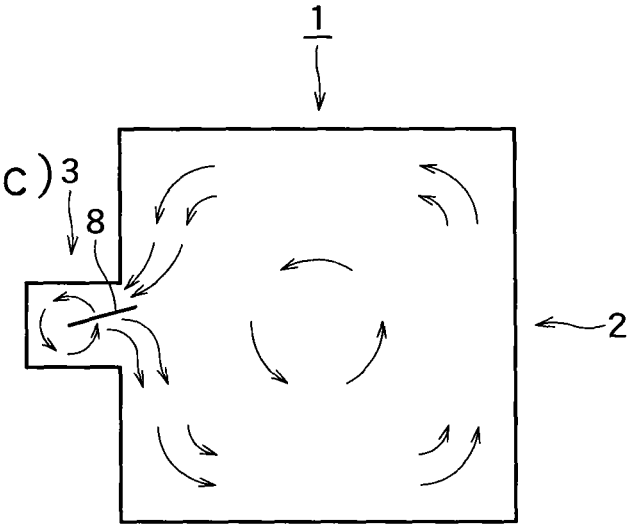
Figure 9:
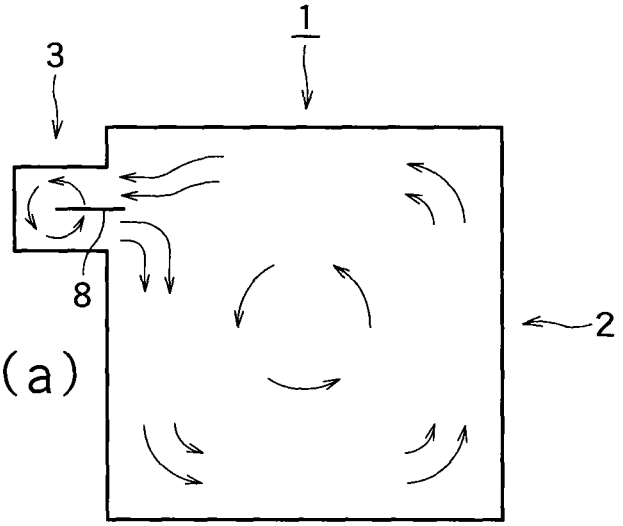
FIGS. 9(*a*) to 9(*c*) are diagrams illustrating the flow of melt, which is generated in a melt circulating drive device and a main bath by the change of the direction of a partition plate, at still another mounting position where the melt circulating drive device is mounted on the main bath.
Figure 9:
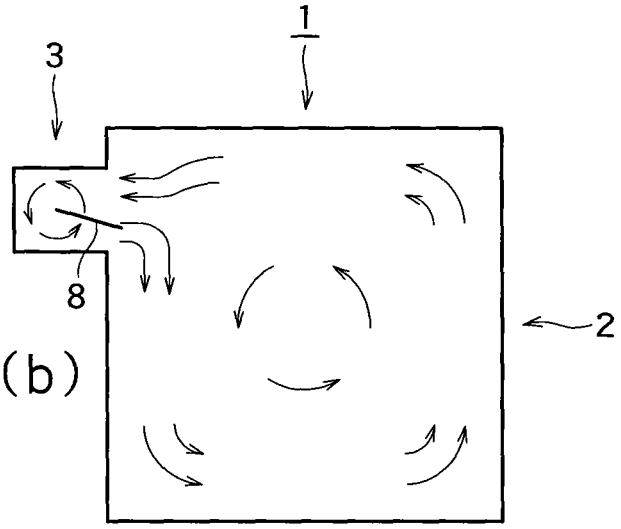
Figure 9:
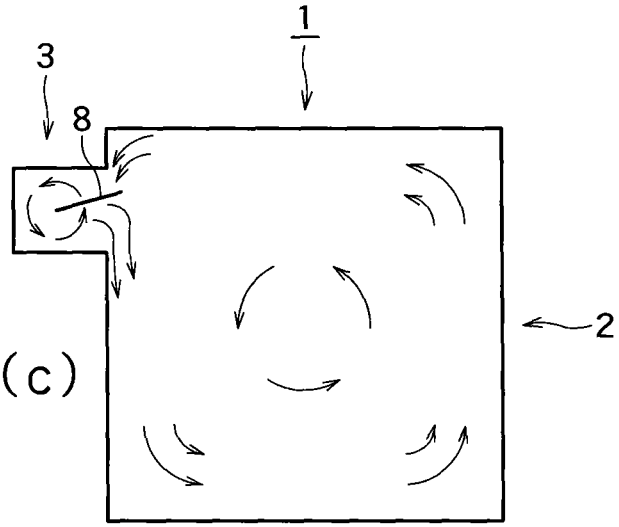

Furthermore, various embodiments of a mounting position where the melt circulating drive device 3 is mounted on the furnace body 2 can also be taken. FIGS. 8(*a*) to 8(*c*) are diagrams illustrating an embodiment in which the melt circulating drive device 3 is mounted on the middle portion of one side surface of the furnace body 2 in the drawing, and FIGS. 9(*a*) to 9(*c*) are diagrams illustrating an embodiment in which the melt circulating drive device 3 is mounted near an upper end of one side surface of the furnace body 2.

Meanwhile, as understood from FIG. 1, it is important that the height h of the drive chamber 5A and the height H of the melt M stored in the melt storage room 2A satisfy "h<H" in the furnace body 2 and the melt circulating drive device 3 communicating with each other.

Even when "h>H" is satisfied, the melt present in the drive chamber 5A starts to be rotated by a shifting magnetic field. However, since a gap is formed between the upper surface of the melt M present in the drive chamber 5A and the lower surface of the upper lid 5*d*, the melt present in the drive chamber 5A causes a complicated movement. For this reason, there also is a case in which a sufficient amount of circulated melt cannot be ensured. In contrast, when "h<H" is satisfied, pressure in the drive chamber 5A is increased. Accordingly, even though there is resistance on the discharge side, it is possible to sufficiently discharge melt.

The inventor performed an experiment under the following conditions to confirm the effect of the melt circulating drive device 3 according to the embodiment of the invention.

The inner diameter ϕ of the drive chamber 5A: 900 mm

The power consumption of the drive motor 6*d*: 5.5 Kw

The height h of the melt tank: 300 mm

The partition plate 8: a neutral position of FIG. 6(*b*)

The results of the experiment were as follows. That is, in FIG. 6(*b*), the flow velocity of the discharge flow FOb (flow velocity of melt, m/min) and the flow rate of the melt (flow rate, Tons/h) were as follow:

| Flow velocity of melt (m/min) | Flow rate (Tons/h) |
|---|---|
| 70 | 1260 |
| 80 | 1440 |
| 90 | 1620 |
| 100 | 1800 |

When these results are compared with those of devices in the related art, results comparable to 2 to 3 times of those of a mechanical pump type device, two times of those of a floor standing type agitator, 0.8 times of those of a up and down shaft type agitator, one time of those of a horizontal mounting type agitator, and 2 to 3 times of those of an electromagnetic agitator were obtained.

According to the above-mentioned embodiment of the invention, the following effects are obtained.

(1) The melt circulating drive device 3 is very compact, and a large amount of circulated melt is obtained.

(2) It is possible to very easily check the inside of the melt storage room 2A by separating the upper lid 5*d* and the heat insulating plate 5*e*.

(3) The leakage of melt to the outside from the drive chamber 5A, which is caused by scattering or the like, does not occur.

(4) Since the partition plate 8 is adapted to be replaceable, the partition plate 8 can be replaced even when the partition plate 8 is worn out. Further, the replacement of the partition plate 8 is performed in a short time due to the structure thereof.

(5) As a result, the melt circulating drive device of which a shutdown time for maintenance is a very short can be obtained.

(6) Since the drive unit 6 is adapted to be mounted on the outside of the melt drive tank 5, it is possible to very easily perform the maintenance of the drive unit 6 itself.

(7) Since the melt circulating drive device 3 and the furnace body 2 are assembled using flange connection, the assembly or disassembly of the melt circulating drive device 3 and the furnace body 2 is also can be performed in a short time.

(8) Since a stainless steel plate for reinforcement does not need to be provided in the melt circulating drive device 3, it is possible to make a design flexible without a concern about the generation of heat.

(9) Since the stainless steel plate is not needed, it is possible to suppress an energy loss to a quarter or less of an energy loss in the related art.

(10) There has been employed a structure in which the melt circulating drive device 3 is mounted on the furnace body (a melting furnace, a holding furnace, or a main bath) 2 so as to be positioned next to the furnace body 2 and the communication between the melt circulating drive device 3 and the furnace body 2 is achieved by the communication between the opening 5B of the melt drive tank 5 of the melt circulating drive device 3 and the communication port 2*b*1 that is formed at the side wall 2*b* of the furnace body 2.

In addition, according to the embodiment of the invention, the following effects can also be obtained.

Generally, melt M is likely to be attached to the inside of a channel and to grow. That is, generally, high-temperature melt M enters a vortex chamber (circulating drive chamber)

from a main bath (furnace body) through an inflow channel, and the temperature of the melt M falls after the high-temperature melt M melts aluminum chips in the vortex chamber. Then, the melt M returns to the furnace body through an outflow channel. During the circulation, aluminum melt forms oxide (dross) by coming into contact with air. This dross is attached to the inner surfaces of the inflow channel and the outflow channel and grows. Accordingly, the dross narrows the flow channel and clogs the flow channel in the worst case. Each of the inflow channel and the outflow channel is narrow, and naturally has a certain length since each of the inflow channel and the outflow channel is a channel. For this reason, an inventor of the invention thinks that it is actually difficult to reliably clean the inside of the inflow channel and the outflow channel from the outside of the main bath or the vortex chamber.

In contrast, in the embodiment of the invention, as particularly understood from FIG. 2, the melt storage room 2A of the furnace body 2 and the drive chamber 5A of the melt circulating drive device 3 do not communicate with each other through two narrow openings (an outflow channel and an inflow channel) formed at the furnace wall (side wall 2*b*). That is, first, the melt storage room 2A and the drive chamber 5A communicate with each other through the large opening 5B formed at the side wall 2*b;* the opening 5B is partitioned into two openings by the partition plate 8 so that the discharge flow channel FC1 and the suction flow channel FC2 are formed; and the melt storage room 2A and the drive chamber 5A communicate with each other through the discharge flow channel FC1 (outflow channel) and the suction flow channel FC2 (inflow channel).

In the embodiment of the invention, the discharge flow channel FC1 and the suction flow channel FC2, which allow the melt storage room 2A of the furnace body 2 and the drive chamber 5A of the melt circulating drive device 3 to communicate with each other, are formed by the division of one original large opening 5B. For this reason, it is easy to form the discharge flow channel FC1 and the suction flow channel FC2 as compared to a case in which an outflow channel and an inflow channel are formed of two small holes individually formed at the side wall 2*b* of the furnace body 2, and there is an advantage in that the discharge flow channel FC1 and the suction flow channel FC2 formed in this way are hardly clogged with melt. In addition, when the partition plate 8 is removed, the diameter of the opening 5B is large and the cleaning (the removal of oxide) of the opening 5B (the discharge flow channel FC1 and the suction flow channel FC2) can also be very easily performed from the outside of the main bath and the vortex chamber. That is, it is possible to very easily perform maintenance that should be necessarily performed as the device is used. The above-mentioned various advantages are peculiar to the embodiment of the invention, and are advantages that cannot be obtained from other devices available to the inventor of the invention.

The invention claimed is:

1. A melt circulating drive device that is mounted on a side wall of a main bath and is driven to agitate nonferrous metal melt present in a melt storage room storing nonferrous metal melt of the main bath, the melt circulating drive device comprising:

a melt drive tank that includes a hermetically-sealed drive chamber, the drive chamber including an opening allowing the drive chamber to communicate with the melt storage room, and the melt drive tank storing melt, which flows from the opening, in the drive chamber;

a melt drive unit that is installed above the melt drive tank, and includes a permanent magnet unit that is rotated about a first up and down axis while making magnetic lines of force pass through along the up and down direction the melt present in the drive chamber of the melt drive tank, and a drive unit for the permanent magnet unit that rotates the melt, which is present in the drive chamber, about the first up and down axis by rotationally driving the permanent magnet unit; and a partition plate that is disposed upright in the drive chamber of the melt drive tank along a direction where the drive chamber and the melt storage room communicate with each other, an outer end of the partition plate being positioned in a region of the opening, an inner end thereof being positioned in the drive chamber, a melt rotating gap being formed between the inner end and an inner surface of the drive chamber facing the inner end, the partition plate dividing the opening of the drive chamber into a first opening and a second opening positioned on both right and left sides of the partition plate, and the melt drive unit rotates the melt in order to collide with one surface of the partition plate to discharge the melt from the first opening, so as to allow external melt to be sucked into the drive chamber, in which the pressure of the melt has been reduced, from the second opening, wherein the partition plate is configured so that the partition plate is fixed to each of fixing portions of the melt drive tank, the fixing portions taking adjusted rotating portions rotated about a second up and down axis at the inner end, gaps of the first and second openings are adjusted depending on the adjusted rotating portions where the partition plate is fixed, and an amount and a direction of melt discharged from the first opening and an amount and a direction of melt sucked from the second opening are adjusted.

2. The melt circulating drive device according to claim 1, wherein the partition plate is detachably mounted on the melt drive tank.

3. The melt circulating drive device according to claim 1, wherein the first up and down axis and the second up and down axis are formed of the same axis.

4. The melt circulating drive device according to claim 1, wherein the melt drive tank includes a container-shaped tank body which includes a bottom wall and side walls and of which an upper side is opened, and an upper lid that closes the upper side.

5. The melt circulating drive device according to claim 1, wherein the permanent magnet unit includes a plurality of permanent magnets that are magnetized in an up and down direction, these permanent magnets are mounted on a bottom surface of a rotating plate at predetermined intervals in a circumferential direction so as to be suspended from the bottom surface, and magnetic poles of lower portions of the plurality of permanent magnets are arranged so that different magnetic poles are alternately arranged in the circumferential direction.

6. A melting furnace comprising:

the melt circulating drive device according to claim 1; and the main bath.

* * * * *